US008054052B2

(12) United States Patent
Noda

(10) Patent No.: US 8,054,052 B2
(45) Date of Patent: Nov. 8, 2011

(54) CONSTANT VOLTAGE CIRCUIT

(75) Inventor: Ippei Noda, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 688 days.

(21) Appl. No.: 12/204,238

(22) Filed: Sep. 4, 2008

(65) Prior Publication Data

US 2009/0066306 A1 Mar. 12, 2009

(30) Foreign Application Priority Data

Sep. 11, 2007 (JP) ..... 2007-235372

(51) Int. Cl.
*G05F 1/00* (2006.01)
*G05F 3/04* (2006.01)

(52) U.S. Cl. ..... 323/265; 323/311

(58) Field of Classification Search ..... 323/265, 323/270, 311, 313–317
See application file for complete search history.

(56) References Cited

U.S. PATENT DOCUMENTS

| | | | | |
|---|---|---|---|---|
| 6,473,340 | B1 * | 10/2002 | Pasotti et al. | 365/185.21 |
| 7,498,780 | B2 * | 3/2009 | Chen et al. | 323/273 |
| 2007/0075939 | A1 * | 4/2007 | Cho et al. | 345/76 |
| 2007/0146010 | A1 * | 6/2007 | Isobe | 326/83 |

FOREIGN PATENT DOCUMENTS

| | | |
|---|---|---|
| JP | 3-158912 | 7/1991 |
| JP | 2004-180472 | 6/2004 |
| JP | 2004-240646 | 8/2004 |
| KR | 2003-0070694 | 9/2003 |
| KR | 10-0665454 | 1/2007 |

* cited by examiner

*Primary Examiner* — Adolf Berhane
*Assistant Examiner* — Jeffrey Gblende
(74) *Attorney, Agent, or Firm* — Cooper & Dunham LLP

(57) ABSTRACT

A constant voltage circuit converts a voltage input to an input terminal and outputs a predetermined constant voltage from an output terminal. The constant voltage circuit includes an output transistor that outputs an electrical current corresponding to a control signal input thereto to the output terminal, a differential amplifier circuit that outputs the control signal according to a difference between a comparative voltage proportional to the output voltage and a predetermined reference voltage, a current mirror circuit that serves as a load of a pair of input transistors included in the differential amplifier circuit, and a voltage comparator that compares a voltage at a control electrode of a transistor included in the current mirror circuit and a voltage of the control signal. The differential amplifier circuit controls a bias electrical current supplied to the pair of input transistors according to a comparison result of the voltage comparison.

5 Claims, 2 Drawing Sheets

CONSTANT VOLTAGE CIRCUIT

BACKGROUND OF THE INVENTION

1. Field of the Invention

The present invention generally relates to a constant voltage circuit of a whole category of electronic equipment aboard a computerized personal organizer, a handset, a voice recognition device, a voice memory device, and a computer, etc.

2. Discussion of the Background

At present, energy saving has been actively promoted to protect environment. For battery-powered electrical equipment, such as mobile phones, digital cameras, etc., energy saving is especially important to prolong battery life. Such portable equipment typically uses a constant voltage circuit.

In constant voltage circuits, in order to quickly respond to fluctuations in output voltage, a bias electrical current, which is hereinafter simply referred to as bias current, in a differential amplifier circuit is typically increased.

However, increasing the bias current causes the constant voltage circuit to consume a greater amount of electrical current.

In view of the foregoing, in a known method, the bias current in the differential amplifier circuit is increased in proportion to the output voltage.

However, phase compensation is difficult in this method because the bias current of the differential amplifier continuously changes. Further, response speed is relatively slow when the output electrical current changes abruptly.

FIG. 1 is a circuit diagram illustrating a known constant voltage circuit that increases bias current of a differential amplifier circuit unit when an output electrical current reaches a predetermined or given value.

As shown in FIG. 1, a constant voltage circuit 100 includes an output transistor M101, PMOS (P-channel Metal Oxide Semiconductor) transistors M102, M103, and M107, NMOS (N-channel Metal Oxide Semiconductor) transistors M104, M105, and M106, a comparator CMP, and resistors R101, R102, and R103.

The constant voltage circuit 100 supplies a drain current of the PMOS transistor M107 that is in proportion to a drain current of the output transistor M101 to the resistor R103. The comparator CMP outputs a high level signal when a decrease in a voltage of the resistor R103 exceeds a reference voltage Vs.

When the comparator CMP outputs the high level signal, the NMOS transistor M106 turns on, which adds a constant current ib from a current source to a bias current ia of the differential amplifier circuit, thus increasing the bias current.

Although the constant voltage circuit 100 shown in FIG. 1 can respond more quickly to abrupt changes in the output electrical current, it is difficult to maintain a high degree of accuracy of the resistor R103 when the constant voltage circuit 100 is an integrated circuit (IC). Consequently, it is difficult to set the output electrical current accurately when the bias current is switched.

The output electrical current when the bias current is switched can be set accurately using a resistor capable of trimming as the resistor R103. However, using such a resistor will increase the cost because an IC chip having a broader area and capable of supporting a trimming process are necessary.

Another known constant voltage circuit detects an output electrical current value based on differences in voltage between both input terminals of a differential amplifier circuit and increases the bias current of the differential amplifier when the voltage difference exceeds a predetermined voltage.

In this constant voltage circuit, because changes in temperature and variations in production process conditions can cause the voltage between a gate and a source of a MOS (Metal Oxide Semiconductor) transistor to fluctuate, it is difficult to set a relation between the output electrical current and the voltage difference between the two input terminals of the differential amplifier circuit accurately.

Further, this constant voltage circuit includes two more differential amplifier circuits in order to measure the voltage difference between the two input terminals of the first differential amplifier circuit, and detects the predetermined voltage using input offset voltage of those two differential amplifier circuits.

However, it is difficult to accurately set the output electrical current at which the bias current is switched similarly to the constant voltage circuit 100 shown in FIG. 1, because the input offset voltage described above fluctuates depending on temperature and production process conditions.

SUMMARY OF THE INVENTION

In view of the foregoing, in one illustrative embodiment of the present invention, a constant voltage circuit is configured to convert voltage input to an input terminal and output a predetermined constant voltage from an output terminal. The constant voltage circuit includes an output transistor, a differential amplifier circuit, a current mirror circuit, and a voltage comparator. The output transistor outputs an electrical current that corresponds to a control signal input thereto to the output terminal. The current mirror circuit serves as a load of a pair of input transistors included in the differential amplifier circuit. The voltage comparator compares a voltage at a control electrode of a transistor included in the current mirror circuit and a voltage of the control signal. The differential amplifier circuit controls a bias electrical current supplied to the pair of input transistors according to a comparison result generated by the voltage comparator and outputs the control signal according to a difference between a comparative voltage proportional to the voltage output from the output terminal and a predetermined reference voltage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
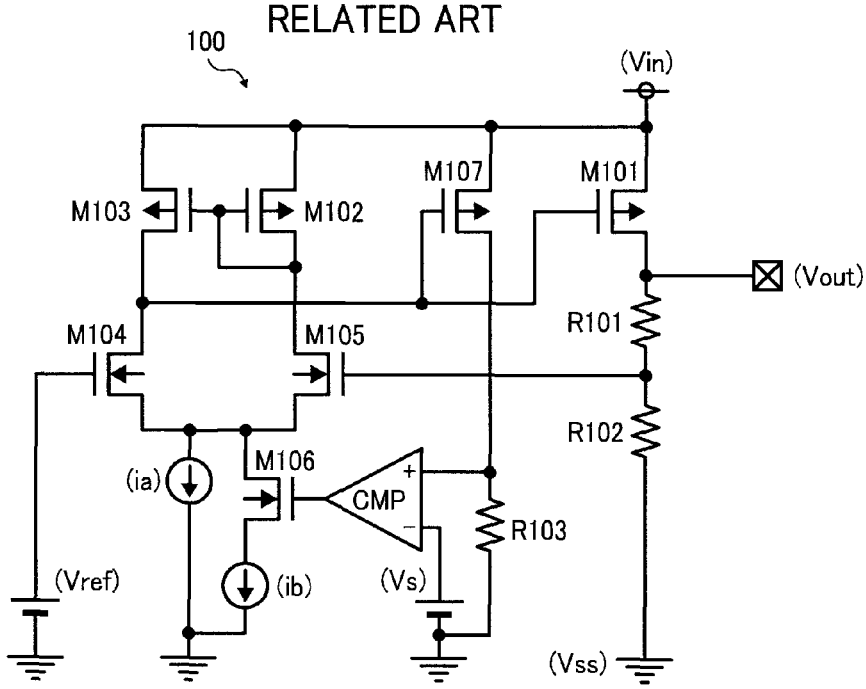
FIG. 1 RELATED ART
FIG. 1 illustrates an example of a related art constant voltage circuit.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 2:
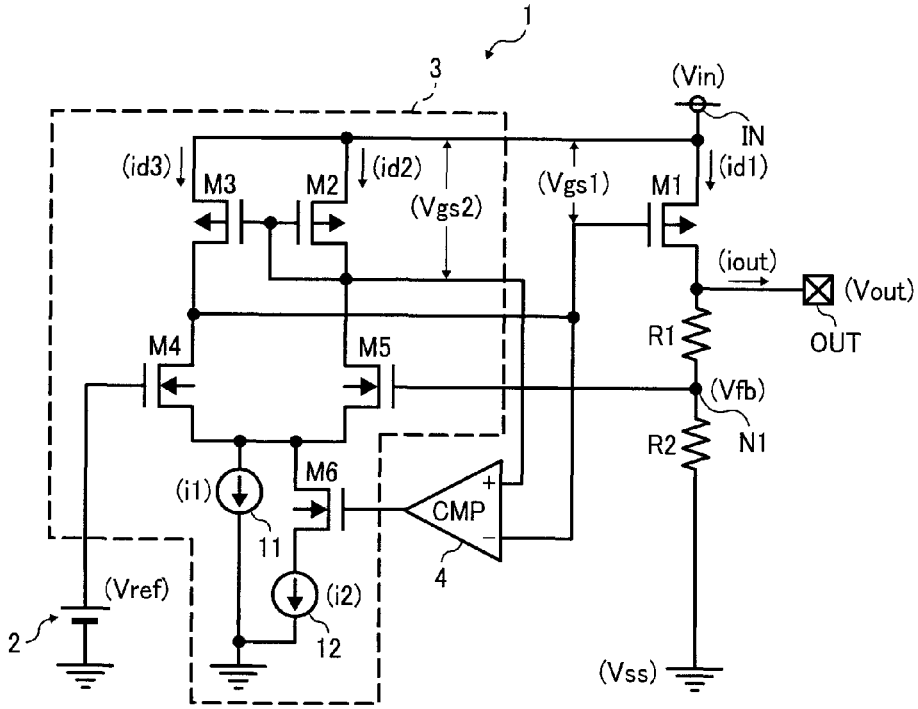
FIG. 2 is an example of a constant voltage circuit according to an illustrative embodiment of the present invention.

Referring now to the drawings, wherein like reference numerals designate identical or corresponding parts throughout the several views thereof, and particularly to FIG. 2, an example of a constant voltage circuit according to an illustrative embodiment of the present invention is described.

Referring to FIG. 2, a constant voltage circuit 1 serves as a series regulator that converts an input voltage $V_{in}$ that is input to an input terminal IN into a predetermined or given constant voltage to be output from an output terminal OUT as an output voltage $V_{out}$.

As shown in FIG. 2, the constant voltage circuit 1 further includes a reference voltage generating circuit 2, resistors R1 and R2, an output transistor M1, a differential amplifier circuit 3, and a hysteresis comparator 4.

The reference voltage generating circuit 2 generates a predetermined or given reference voltage $V_{ref}$ and outputs the reference voltage $V_{ref}$ to the differential amplifier circuit 3.

The resistors R1 and R2 are connected in series between the output terminal OUT and a ground voltage Vss and serve as a voltage divider that divides the output voltage $V_{out}$ so as to generate a divided voltage $V_{fb}$. A potential at a node N1 between the resistor R1 and the resistor R2 is output as the divided voltage $V_{fb}$ and used as a reference voltage to detect the output voltage $V_{out}$.

The output transistor M1 can be a PMOS transistor, for example, and regulates an electrical current $i_{out}$ that is output to the output terminal OUT according to a signal input to a gate of the output transistor M1. The electrical current $i_{out}$ is hereinafter referred to as the output current $i_{out}$. A source of the output transistor M1 connects to the input terminal IN at an identical or similar potential, and a drain thereof connects to the output terminal OUT at an identical or similar potential.

The differential amplifier circuit 3 controls the output transistor M1 so that the divided voltage $V_{fb}$ is equalized at or close to the reference voltage $V_{ref}$, and operates in conjunction with the hysteresis comparator 4 as a differential amplifier circuit unit.

As shown in FIG. 2, the differential amplifier circuit 3 includes PMOS transistors M2 and M3; NMOS transistors M4, M5, and M6; and constant current sources 11 and 12. The constant current sources 11 and 12 supply predetermined or given constant electrical currents $i_1$ and $i_2$, respectively.

The reference voltage $V_{ref}$ is input to an inverting input terminal of the differential amplifier circuit 3, and the divided voltage $V_{fb}$ is input to a non-inverting input terminal thereof. An output terminal of the differential amplifier circuit 3 connects to the gate of the output transistor M1.

The NMOS transistors M4 and M5 are input transistors that operate in conjunction as a differential pair. A gate of the NMOS transistor M4 functions as an inverting input terminal to which the reference voltage $V_{ref}$ is input, and a gate of the NMOS transistor M5 functions as a non-inverting input terminal to which the divided voltage $V_{fb}$ is input.

The PMOS transistors M2 and M3 form a mirror circuit that serves as a load of the differential pair. Sources of the PMOS transistors M2 and M3 connect to the input voltage $V_{in}$ at an identical or similar potential. Gates of the PMOS transistors M2 and M3 and a drain of the PMOS transistor M2 connect to each other at an identical or similar potential.

The drain of the PMOS transistor M2 further connects to a drain of the NMOS transistor M5 at an identical or similar potential. A drain of the PMOS transistor M3 connects to a drain of the NMOS transistor M4 at an identical or similar potential, forming a connection that serves as the output terminal of the differential amplifier circuit 3 and connects to the gate of the output transistor M1.

Sources of the NMOS transistors M4 and M5 connect to each other at an identical or similar potential, and the constant current source 11 is located between a node between the sources of the NMOS transistors M4 and M5 and the ground potential Vss. The constant current source 11 is connected in parallel to the NMOS transistor M6 and the constant current source 12, which are connected serially.

A drain of the NMOS transistor M6 connects to each of the sources of the NMOS transistors M4 and M5 at an identical or similar potential, and a source of the NMOS transistor M6 connects to the constant current source 12. A gate of the NMOS transistor M6 connects to an output terminal of the hysteresis comparator 4.

The hysteresis comparator 4 functions as a voltage comparator in the differential amplifier circuit unit. A non-inverting input terminal of the hysteresis comparator 4 connects to the gate of the PMOS transistor M2 at an identical or similar potential, and an inverting input terminal thereof connects to the gate of the output transistor M1 at identical or similar potential.

In the configuration described above, when a voltage at the gate (gate voltage) of the output transistor M1 decreases to a voltage lower than a gate voltage of the PMOS transistor M2, the hysteresis comparator 4 raises an output signal to high, turning the NMOS transistor M6 on.

When the NMOS transistor M6 is on, a bias current supplied to the NMOS transistors M4 and M5 increases from the constant electrical current $i_1$ to a sum of the constant electrical current $i_1$ and $i_2$.

Voltages between the gate and source of each of the output transistor M1 and the PMOS transistor M2 are described below.

The voltages between the gate and source of the output transistor M1 and the PMOS transistor M2 are hereinafter referred to as gate/source voltages $V_{gs1}$ and $V_{gs2}$, respectively, and are respectively expressed by formulas 1 and 2 shown below:

$$V_{gs1}=V_{th}+(2\times i_{d1}/\beta 1)0.5 \quad (1)$$

$$V_{gs2}=V_{th}+(2\times i_{d2}/\beta 2)0.5 \quad (2)$$

wherein Vth represents a threshold voltage of the PMOS transistor M2, $i_{d1}$ represents an electrical current at the drain (hereinafter drain electrical current) of the output transistor M1, which is close to the output current $i_{out}$, and $i_{d2}$ represents a drain electrical current of the PMOS transistor M2.

Further, β1 and β2 described above are respectively defined as follows:

$$\beta 1=\mu\times COX\times W1/2\times L1 \quad (3)$$

$$\beta 2=\mu\times COX\times W2/2\times L2 \quad (4)$$

wherein μ represents mobility, COX represents a gate oxide film capacity, W1 represents a width of the gate of the output transistor M1, L1 represents a length of the gate of the output transistor M1, W2 represents a width of the gate of the PMOS transistor M2, and L2 represents a length of the gate of the PMOS transistor M2.

Figure 3:
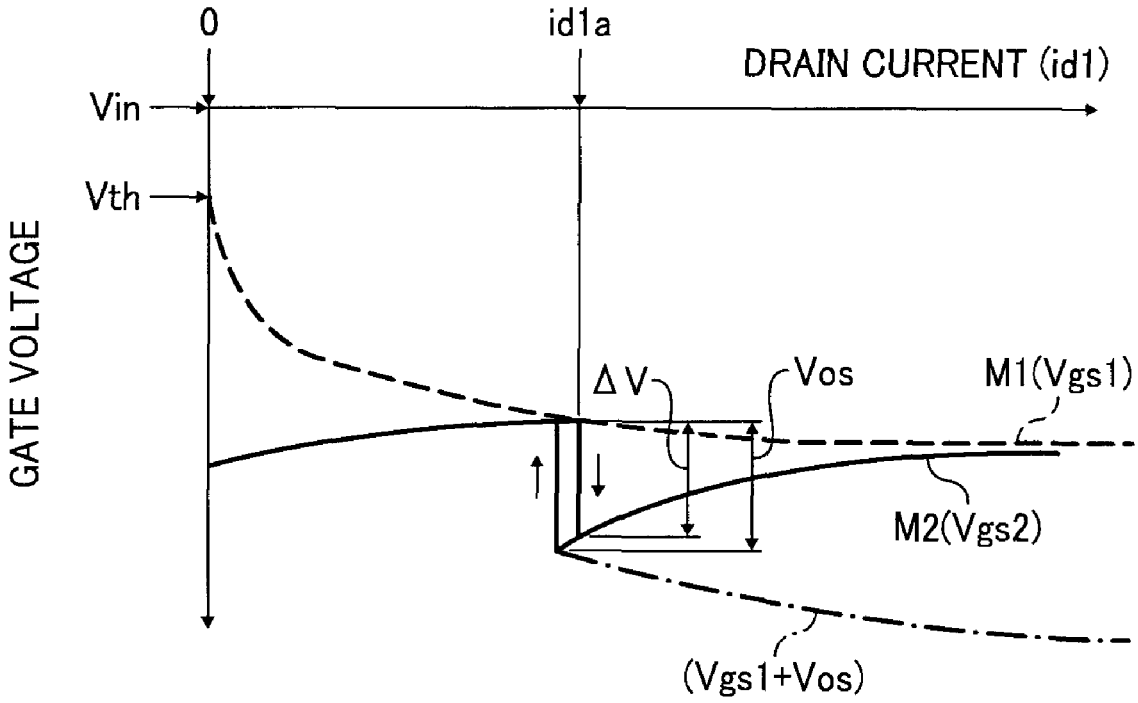
FIG. 3 illustrates an example of relations between a drain electrical current of an output transistor, a gate/source voltage of an output transistor, and a gate/source voltage of a PMOS transistor shown in FIG. 2.

FIG. 3 illustrates an example of relations between the drain electrical current $i_{d1}$ of the output transistor Ml, the gate/source voltage $V_{gs1}$ of the output transistor M1, and the gate/source voltage $V_{gs2}$ of the PMOS transistor M2.

It is to be noted that the gate/source voltages $V_{gs1}$ and $V_{gs2}$ are shown with reference to the input voltage $V_{in}$.

Further, it is to be noted that, alternatively, the output current $i_{out}$ can be used instead of the drain electrical current id1 of the output transistor M1 because they are substantially equal to each other.

In FIG. 3, a dashed line indicates the gate/source voltage $V_{gs1}$ of the output transistor M1, and a solid line indicates the gate/source voltage $V_{gs2}$ of the PMOS transistor M2.

When the drain electrical current $i_{d1}$ is 0 ampere, $V_{gs1}=V_{th}$ and $V_{gs2}=V_{th}+(2\times id1/\beta 2)0.5$, and thus $V_{gs1}<V_{gs2}$.

Because a voltage at the source (source voltage) of each of the output transistor M1 and the PMOS transistor M2 is identical or similar to the input voltage $V_{in}$, when the drain electrical current $i_{d1}$ increases, the gate/source voltage $V_{gs1}$ increases and the gate/source voltage $V_{gs2}$ decreases.

Then, when the voltage at the gate (gate voltage) of the output transistor M1 increases and the gate voltage of the PMOS transistor M2 decreases to an extent that the gate/source voltage $V_{gs1}$ equals the gate/source voltage $V_{gs2}$, the hysteresis comparator 4 switches its output signal. Thus, when the output signal of the hysteresis comparator 4 is high, the NMOS transistor M6 turns on.

The bias current of the differential amplifier circuit 3 increases according to the mechanism described above.

It is assumed that the drain electrical current $i_{d1}$ of the output transistor M1 and the drain electrical current $i_{d2}$ under the conditions described above are $i_{d1a}$ and $i_{d2a}$, respectively. Because the gate/source voltage $V_{gs1}$ equals the gate/source voltage $V_{gs2}$, formula 5 shown below can be obtained from formulas 1 and 2 described above.

$$V_{th}+(2\times i_{d1a}/\beta 1)0.5=V_{th}+(2\times i_{d2a}/\beta 2)0.5 \quad (5)$$

When identical elements are deleted from both sides of formula 5, formula 6 shown below is obtained.

$$(i_{d1a}/\beta 1)0.5=(i_{d2a}/\beta 2)0.5 \quad (6)$$

Further, when β1 and β2 described in formula 3 and 4 are applied to formula 6, formula 7 shown below is obtained.

$$i_{d1a}/(W1/L1)=i_{d2a}/(W2/L2) \quad (7)$$

From formula 7, formula 8 that defines the drain electrical current $i_{d1a}$ of the output transistor M1 is obtained as shown below.

$$i_{d1a}=i_{d2a}\times(W1/L1)/(W2/L2) \quad (8)$$

The gate voltage of the output transistor M1 is identical or similar to a drain voltage of the PMOS transistor M3, and the drain voltage and the gate voltage of the PMOS transistor M2 are identical or similar to each other.

Therefore, when the gate/source voltage $V_{gs1}$ is identical or similar to the gate/source voltage $V_{gs2}$, the drain voltage of the PMOS transistor M2 is identical or similar to that of the PMOS transistor M3. Further, because the gates of the PMOS transistors M2 and M3 connect to each other and are at an identical or similar voltage, the drain electrical current of the PMOS transistor M2 is identical or similar to that of the PMOS transistor M3.

Because the PMOS transistors M2 and M3 form a current mirror circuit as described above, when a sum of their drain electrical currents is identical or similar to the constant current $i_1$, that is, when the NMOS transistor M6 is off, the drain electrical current id2*a* of the PMOS transistor M2 is half the constant current $i_1$ ($i_1/2$) when the gate-source voltage $V_{gs1}$ equals the gate-source voltage $V_{gs2}$($V_{gs1}=V_{gs2}$).

By applying this value to formula 8 described above, the drain electrical current id1*a* at which the bias current is increased is expressed by formula 9 shown below.

$$i_{d1a}=(i_1/2)\times(W1\times L2)/(W2\times L1) \quad (9)$$

It is to be noted that a bias current of an amplifier circuit used in a semiconductor device is typically settable with a higher degree of accuracy, and a width and a length of a gate of a MOS transistor is settable with a higher degree of accuracy.

Thus, the right side of formula 9 can be set with a higher degree of accuracy, and the drain electrical current id1*a* at which the bias current of the differential amplifier circuit 3 is increased can be set with a higher degree of accuracy.

Further, because the drain electrical current id1 substantially equals to the output current $i_{out}$, the constant voltage circuit 1 according to the present embodiment can set the output electrical current at which the bias current is increased with a higher degree of accuracy.

It is to be noted that, when the bias current of the differential amplifier circuit 3 increases, the drain electrical current id2 of the PMOS transistor M2 increases according to the increase in that bias current.

Therefore, the gate/source voltage $V_{gs2}$ of the PMOS transistor M2 changes as indicated by a downward arrow shown in FIG. 3. Hereinafter, the amount of change in the gate/source voltage $V_{gs2}$ is referred to as a voltage change amount ΔV. Subsequently, the voltage at the non-converting input terminal of the hysteresis comparator 4 decreases.

The hysteresis comparator 4 provides a hysteresis voltage $V_{os}$ shown in FIG. 3 in order to prevent the output signal from being switched due to the decrease in the voltage at the non-converting input terminal of the hysteresis comparator 4.

The constant voltage circuit 1 can operate reliably because of the hysteresis characteristic of the hysteresis comparator 4 the described above.

It is to be noted that, although a comparator without hysteresis characteristics is usable instead of the hysteresis comparator 4, the hysteresis comparator 4 is preferable for reliable operation of the constant voltage circuit 1.

As shown in FIG. 3, the hysteresis voltage $V_{os}$ is set to a voltage slightly higher than the voltage change amount ΔV. When the drain electrical current id1 decreases, the hysteresis comparator 4 turns the output signal low when a sum of the gate/source $V_{gs1}$ and the hysteresis voltage $V_{os}$ ($V_{gs1}+V_{os}$) is equal to or less than the gate/source $V_{gs2}$.

Subsequently, the NMOS transistor M6 turns off, and the bias current of the differential amplifier circuit 3 is equal or similar to the constant electrical current $i_1$, which causes the gate/source voltage $V_{gs2}$ of the PMOS transistor to increase as indicated by an upward arrow shown in FIG. 3. In this state, the voltage change amount ΔV is equal or similar to the hysteresis voltage $V_{os}$.

As described above, the constant voltage circuit 1 according to the present embodiment can set the value of the output current $i_{out}$ at which the bias current of the differential amplifier circuit 3 is increased based on the bias current (constant current $i_1$), and the widths and lengths of the gates of the MOS transistors, which are parameters settable with a higher degree of accuracy.

Therefore, in the present embodiment, electrical current consumption can be reduced, response speed to abrupt changes in the output electrical current can be increased, and the value of the output current at which the bias current of the differential amplifier circuit is increased can be set more accurately.

Numerous additional modifications and variations are possible in light of the above teachings. It is therefore to be understood that, within the scope of the appended claims, the disclosure of this patent specification may be practiced otherwise than as specifically described herein.

This patent specification is based on Japanese Patent Application No. 2007-235372, filed on Sep. 11, 2007 in the Japan Patent Office, the entire contents of which are hereby incorporated by reference herein.

What is claimed is:

1. A constant voltage circuit configured to convert voltage input to an input terminal and output a predetermined constant voltage from an output terminal, the constant voltage circuit comprising:

an output transistor configured to output an electrical current in response to a control signal input thereto to the output terminal;

a differential amplifier circuit configured to output the control signal according to a difference between a comparative voltage proportional to the voltage output from the output terminal and a predetermined reference voltage;

a current mirror circuit configured to serve as a load of a pair of input transistors included in the differential amplifier circuit; and a voltage comparator configured to compare a voltage at a control electrode of a transistor included in the current mirror circuit and a voltage of the control signal, the differential amplifier circuit controlling a bias electrical current supplied to the pair of input transistors according to a comparison result generated by the voltage comparator.

2. The constant voltage circuit according to claim 1, wherein the voltage comparator has a hysteresis characteristic.

3. The constant voltage circuit according to claim 2, wherein hysteresis of the voltage comparator is greater than an increase in a voltage at a gate of the transistor included in the current mirror circuit when the bias electrical current increases.

4. The constant voltage circuit according to claim 1, wherein the differential amplifier circuit increases the bias electrical current when the comparison result indicates that the voltage at the control electrode of the transistor included in the current mirror circuit is not less than the voltage of the control signal.

5. The constant voltage circuit according to claim 1, wherein the output transistor and the transistor included in the current mirror circuit are MOS transistors of an identical conductive type, and the voltage comparator compares a voltage between a gate and a source of the output transistor with a voltage between the gate and a source of the transistor included in the current mirror circuit.

* * * * *